US006932338B1

(12) United States Patent
Popejoy et al.

(10) Patent No.: US 6,932,338 B1
(45) Date of Patent: Aug. 23, 2005

(54) FRICTION SHEET FEEDING MACHINE WITH REVERSIBLE DRIVEN RETARD ROLLER

(75) Inventors: William L. Popejoy, Champlin, MN (US); Perry D. Bergman, Fridley, MN (US)

(73) Assignee: Streamfeeder, LLC, Minneapolis, MN (US)

( * ) Notice: Subject to any disclaimer, the term of this patent is extended or adjusted under 35 U.S.C. 154(b) by 0 days.

(21) Appl. No.: 10/696,951

(22) Filed: Oct. 30, 2003

Related U.S. Application Data

(60) Provisional application No. 60/423,239, filed on Nov. 1, 2002.

(51) Int. Cl.[7] ..... B65H 3/52
(52) U.S. Cl. ..... 271/122; 271/124; 271/35
(58) Field of Search ..... 271/122, 124, 271/125, 35, 138

(56) References Cited

U.S. PATENT DOCUMENTS 3,771,783 A * 11/1973 McInerny ..... 271/125
4,083,555 A 4/1978 Irvine et al.
4,544,147 A * 10/1985 Dinnissen ..... 271/35
4,546,963 A * 10/1985 Dinnissen ..... 271/35
4,586,705 A * 5/1986 Satoh et al. ..... 271/122
4,651,983 A * 3/1987 Long ..... 271/35
5,003,485 A 3/1991 Francisco
5,076,563 A 12/1991 Namba et al.
5,232,211 A 8/1993 Kubota et al.
5,244,198 A * 9/1993 Green ..... 271/125
5,269,505 A 12/1993 Sardano
6,050,562 A * 4/2000 Long ..... 271/10.03
2002/0067939 A1 6/2002 Hamada et al.
2002/0130459 A1 9/2002 Ramirez

* cited by examiner

*Primary Examiner*—David H. Bollinger
(74) *Attorney, Agent, or Firm*—Sherrill Law Offices, PLLC

(57) ABSTRACT

A friction sheet feeding machine having (i) a tray for holding a stack of sheets, (ii) a driven friction feed roller for contacting a downward facing major surface of a lowermost sheet in a stack retained within the tray and pulling the lowermost sheet in a machine direction from underneath the stack, (iii) a reversibly driven friction retard roller vertically spaced in parallel relationship above the friction feed roller for contacting a leading edge and any exposed upward facing major surface of a sheet immediately overly the lowermost sheet so as to retard advancement of the overlying sheet, (iv) a first motor operably connected to the friction feed roller for driving the friction feed roller, and (v) a second motor operably connected to the friction retard roller for driving the friction retard roller, wherein the first and second motors are operably associated such that the second motor is operational only when the first motor is operated.

3 Claims, 5 Drawing Sheets

FRICTION SHEET FEEDING MACHINE WITH REVERSIBLE DRIVEN RETARD ROLLER

This application claims priority to U.S. Provisional Patent Application Ser. No. 60/423,239 filed Nov. 1, 2002.

FIELD OF INVENTION

The invention relates to friction sheet feeding machines for feeding individual sheets from a stack of sheets. More particularly, the invention relates to gating systems on friction sheet feeding machines.

BACKGROUND

A wide variety of friction sheet feeding machines are available for feeding individual sheets from the bottom of an essentially vertical stack of sheets. These machines typically include (i) a tray for holding a stack of sheets in an essentially vertical position, (ii) a nip for feeding a lowermost sheet from the stack, (iii) a driven friction roller or belt for contacting the downward facing major surface of the lowermost sheet in the stack and pulling the lowermost sheet from underneath the sheet stack towards the nip, and (iv) a friction retard surface positioned above the driven friction roller for contacting the leading edge(s) and any exposed upward facing major surface(s) of the sheet(s) positioned directly above the lowermost sheet for retarding advancement of the sheet(s) directly above the lowermost sheet and thereby facilitating separation of the lowermost sheet from the immediately overlying sheet prior to introduction of the lowermost sheet into the feed nip.

Friction retard surfaces having a wide variety of sizes, shapes, contours, coefficient of friction, etc., have been employed over the years. Rotating friction retard rollers have also been employed, with the retard roller rotated in a forward direction on some machines and rotated in a reverse direction on others. While a forward rotating friction retard roller provides significant advantages when feeding certain types of sheets, such as coarse flat product, and a reverse rotating friction retard roller provides significant advantages when feeding other types of sheets, such as coated, glossy, printed product, the direction of rotation limits the types of sheets which may be reliably fed through the friction sheet feeding machine.

Accordingly, a need exists for a friction sheet feeding machine capable of providing the advantages associated with a rotating friction retard roller without the limitations also associated with a rotating friction retard roller.

SUMMARY OF THE INVENTION

Figure 1:
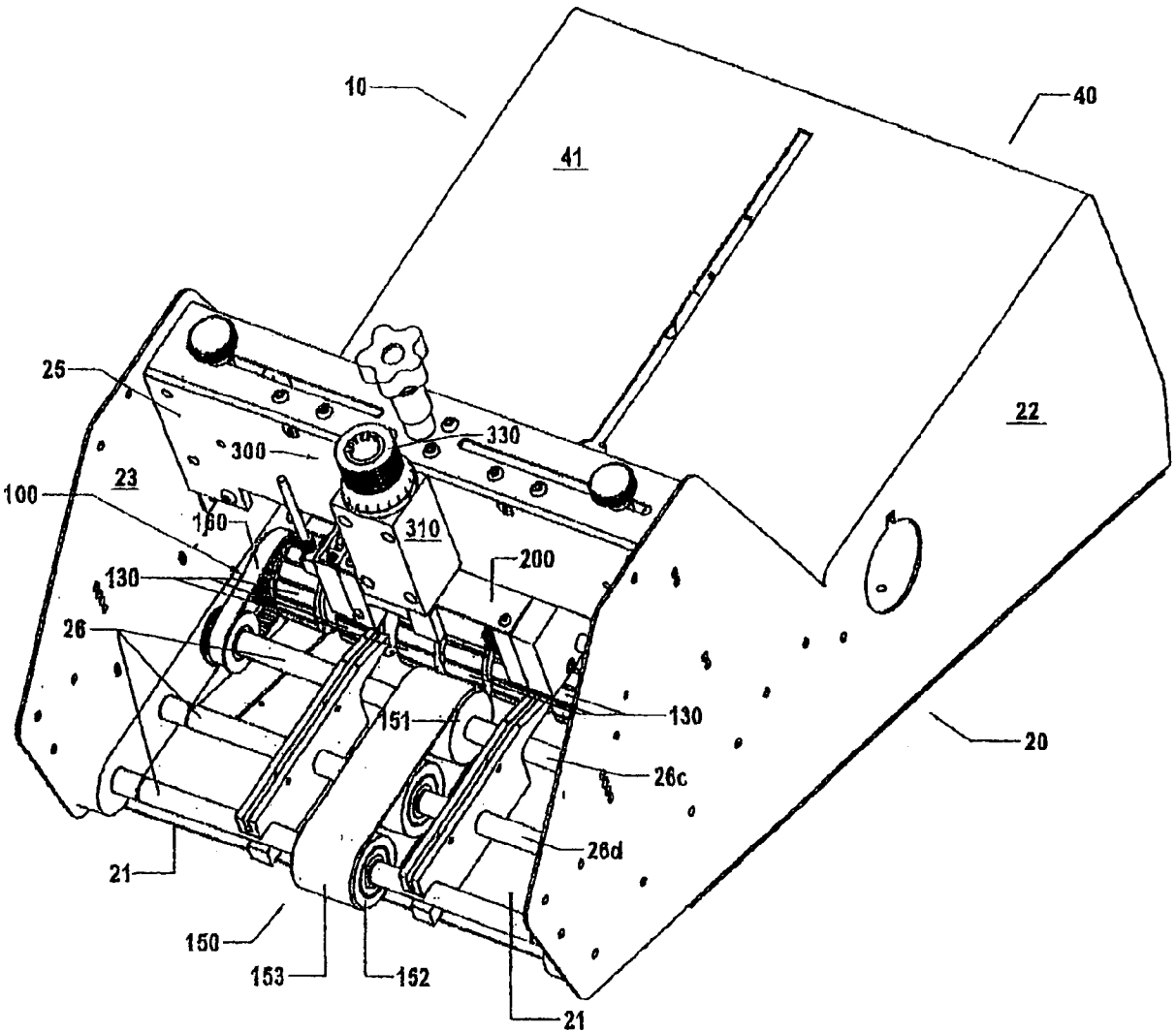
FIG. 1 is a front perspective view of one embodiment of the invention.

The invention is a friction sheet feeding machine which includes a tray, a driven friction feed roller, and a driven friction retard roller. The tray is effective for holding a stack of sheets in a substantially vertical position. The friction feed roller is configured and arranged relative to the tray for contacting the downward facing major surface of a lowermost sheet in a stack retained within the tray and pulling the lowermost sheet from underneath the stack. The friction retard roller is vertically spaced in parallel relationship above the friction feed roller for contacting the leading edge and any exposed upward facing major surface of the sheet immediately overlying the lowermost sheet so as to retard advancement of the overlying sheet, wherein driven rotation of the friction retard roller is reversible as between a concurrent direction relative to the friction feed roller when in a first state and a countercurrent direction relative to the friction feed roller when in a second state.

DETAILED DESCRIPTION OF THE INVENTION INCLUDING A BEST MODE

Nomenclature

010 Friction Sheet Feeding Machine
020 Frame
021 Base Plate
022 First Side Panel
023 Second Side Panel
025 Cross Member
026 Support Rods
**026*a*** First Support Rod
**026*b*** Second Support Rod
**026*c*** Third Support Rod
**026*d*** Fourth Support Rod
040 Tray Assembly
041 Floor of Tray Assembly
100 Drive Assembly
120 Friction Feed Rollers
125 Idler Rollers
130 Friction Belt
140 Drive Belt
150 Conveyor System
151 Driven Conveyor Roller
152 Idler Conveyor Roller
153 Conveyor Belt
160 Drive Belt
200 Gating Assembly
210 Friction Retard Roller
211 Central Shaft
**211*g*** Radial Groove on Central Shaft
212 Bearings
220 Auxiliary Electric Motor
**220*d*** Drive Shaft of Auxiliary Electric Motor
221 Motor Mount
222 Machine Screws
223 Machine Screws
230 Switch
231 Slide Button on Switch
232 Switch Housing
233 Switch Mount
234 Switch Position Indicator Label
235 Machine Screws
236 Machine Screws
237 Connector
240 Protective Cover

241 Machine Screws
250 Mounting Base
251 First Support Arm
252 Second Support Arm
253 Machine Screws
254 Machine Screws
259 Bore in Mounting Base
260 Gear Assembly
261 First Spur Gear
262 Second Spur Gear
263 Third Spur Gear
264 Shaft Lock
265 Cover
266 Machine Screws
267 Bearing
268 Pin
271 Pull Knobs
271*a* First Pull Knob
271*b* Second Pull Knob
272 Set Screws
275 Ball Plunger
300 Height Adjustment System
310 Mounting Block
311 Machine Screws
319 Transverse Channel Through Mounting Block
320 Lift Shaft
320*c* Central Portion of Lift Shaft
320*d* Distal End of Lift Shaft
320*p* Proximal End of Lift Shaft
330 Dial
330 Insert
332 Threaded Shaft
333 Mounting Flange
334 Machine Screws
335 Dial Position Indicator
340 Cap Screw
351 Spring
352 Bearing
500 Stack of Sheets
S Individual Sheets
$S_{low}$ Lowermost Sheet
$S_{over}$ Overlying Sheet
$S_{lead}$ Leading Edge of Sheets in Sheet Stack Definitions As utilized herein, including the claims, the phrase "concurrent direction," when used to describe rotation of a roller relative to an neighboring parallel roller, means that the rollers are moving in the same direction at that point where the rollers are closest to one another (i.e., one roller rotates clockwise while the other rotates counterclockwise).

As utilized herein, including the claims, the phrase "countercurrent direction," when used to describe rotation of a roller relative to an neighboring parallel roller, means that the rollers are moving in opposite directions at that point where the rollers are closest to one another (i.e., both roller rotate clockwise or both rollers rotate counterclockwise).

As utilized herein, including the claims, the term "releasable, " means capable of rapid (i.e., averaging less than one minute) and repeated attachment and detachment by hand.

Construction

The friction sheet feeding machine 10 includes a frame 20, a tray assembly 40, a drive assembly 100, a gating assembly 200, and a height adjustment system 300. The machine 10 is capable of serially feeding individual sheets S in a lateral direction (unnumbered) from the bottom (unnumbered) of a generally vertical stack 500 of sheets S retained within the tray assembly 40.

As shown in FIG. 1, a suitable configuration for frame 20 is a generally rectangular frame 20 having (i) a generally horizontal base plate 21, (ii) a first side panel 22 extending upward from the base plate 21, (iii) a second side panel 23 also extending upward from the base plate 21, (iv) a rear end plate (not shown) extending upward from the base plate 21 and laterally interconnecting the side panels 22 and 23, (v) a lateral cross member 25 transversely spaced above the base plate 21 and interconnecting the side panels 22 and 23, and (vi) a plurality of laterally extending support rods 26 extending between and interconnecting the side panels 22 and 23. Other frame configurations may also be employed, such as a cross-beam construction rather than the plate construction shown in FIG. 1.

Tray assembly 40 is effective for holding a stack 500 of individual sheets S in a substantially vertical position with a slight biasing of at least the lower portion (unnumbered) of the stack 500 towards the friction feed roller(s) 120 and the friction retard roller(s) 210.

One means for achieving the desired biasing of the stack 500, shown in FIG. 1, is to incline the floor 41 of the tray assembly 40 towards the friction feed roller(s) 120 and the friction retard roller(s) 210. Other means are known and may also be employed, such as a transversely extending strip (not shown) positioned within the tray assembly 40 for supporting the trailing edges (not shown) of the sheets S in the stack 500 wherein the lower portion (unnumbered) of the support strip is curved towards the friction feed roller 120 and the friction retard roller 210.

Generally, drive assembly 100 includes a primary drive motor (not shown) and a friction feed roller(s) 120 driven by the primary drive motor. The friction feed roller(s) 120 can directly contact the sheets S or can be used to drive a friction belt 130 which contacts the sheets S.

Figure 2:
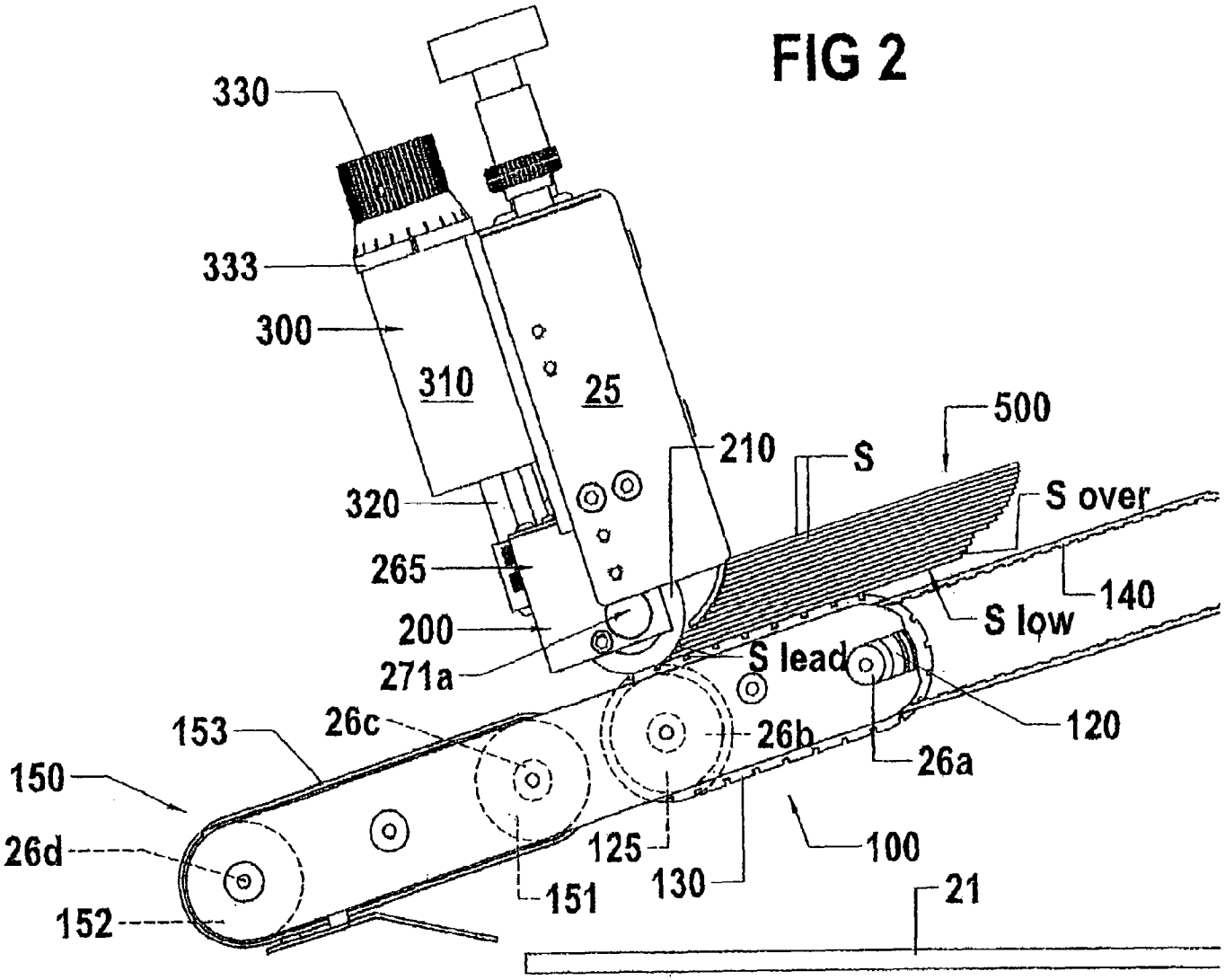
FIG. 2 is a partial side of the machine shown in FIG. 1 with the side panel removed to facilitate viewing of internal components.

Referring generally to FIGS. 1 and 2, one embodiment of a suitable drive assembly 100 includes a primary drive motor (not shown), and a plurality of laterally aligned and laterally spaced friction belts 130 each mounted onto a driven friction feed roller 120 and an idler roller 125 wherein the idler rollers 125 are longitudinally aligned and longitudinally spaced with each associated friction feed roller 120. The friction feed rollers 120 are mounted upon a laterally extending first support rod 26*a* which is rotatably attached to the side panels 22 and 23 of the frame 20. Similarly, the idler rollers 125 are mounted upon a laterally extending second support rod 26*b* which is longitudinally spaced from the first support rod 26*a* and also rotatably attached to the side panels 22 and 23 of the frame 20. The first support rod 26*a* is driven by the primary drive motor (not shown) via drive belt 140.

The embodiment of the drive assembly 100 shown in FIGS. 1 and 2 further includes a conveyor system 150 downstream from the friction belts 130 for receiving individual sheets S fed from the sheet stack 500 by the friction belts 130 and conveying the fed sheets S to the desired location, typically a conveyor belt (not shown) timed to receive and collate sheets S fed from several aligned friction sheet feeding machines 10. The conveyor system 150 shown in FIGS. 1 and 2 includes a conveyor belt 153 mounted onto a driven conveyor roller 151 and an idler conveyor roller 152 wherein the idler conveyor roller 152 is longitudinally aligned with and longitudinally spaced from the driven conveyor roller 151. The driven conveyor roller 151 is mounted upon a laterally extending third support rod 26*c* which is rotatably attached to the side panels 22 and 23 of the frame 20. Similarly, the idler conveyor roller 152 is mounted upon a laterally extending fourth support rod 26*d* which is longitudinally spaced from the third support rod 26*c* and also rotatably attached to the side panels 22 and 23 of the frame 20. The third support rod 26*c* is driven by the second support rod 26*b* via drive belt 160.

Gating assembly 200 includes a friction retard roller(s) 210 driven by an auxiliary electric motor 220 wherein the direction of rotation of the retard roller(s) 210 is reversible as between a forward (concurrent) direction and a reverse (counter current) direction so as to permit customized operation of the friction sheet feeding machine 10 to accommodate feeding of a wide variety of different sheets S. The ability to reverse the rotational direction of the driven friction retard roller(s) 210 allows the retard roller(s) 210 to rotate concurrently with the friction feed roller(s) 120 when in a first state and rotate countercurrent to the friction feed roller(s) 120 when in a second state.

Figure 3:
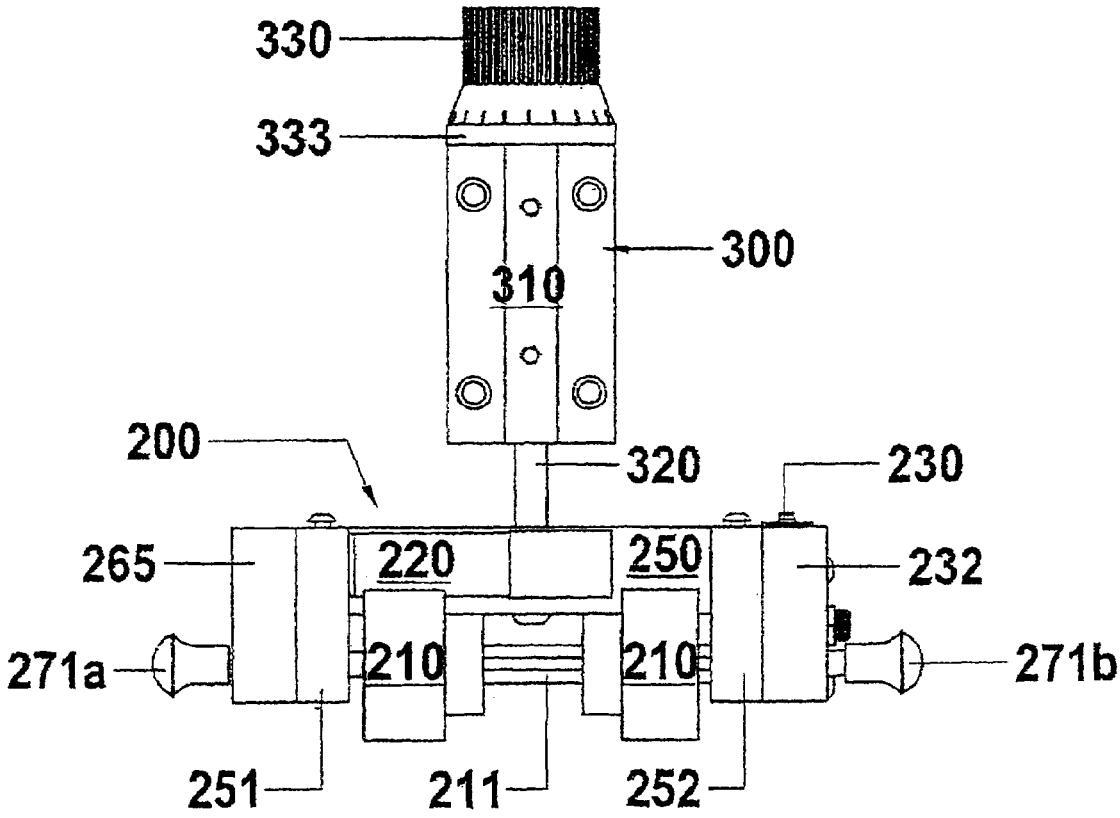
FIG. 3 is a front perspective view of one embodiment of the gating assembly and height adjustment assembly shown in FIG. 1.
Figure 4:
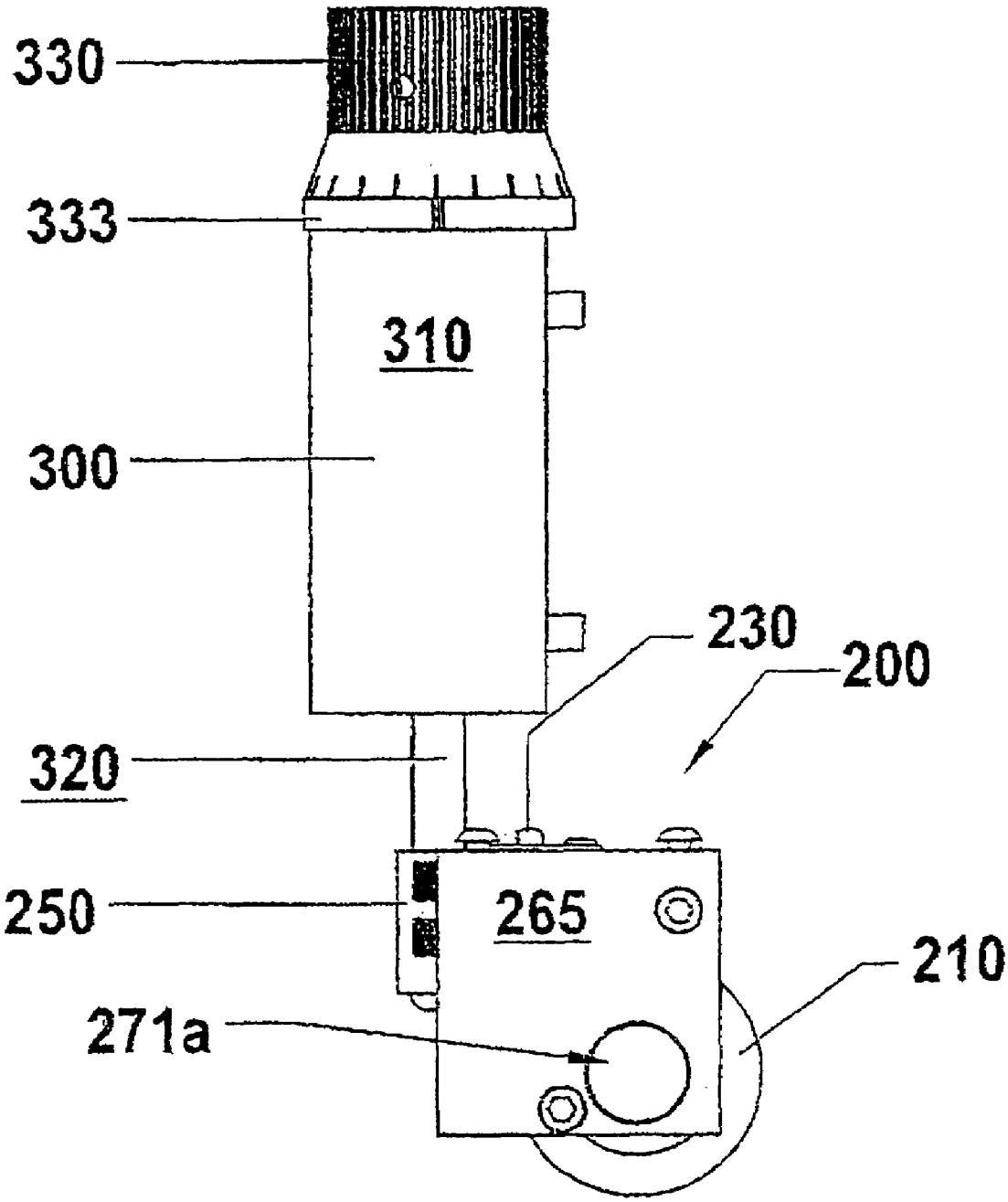
FIG. 4 is a side view of the gating assembly and height adjustment assembly shown in FIG. 3.
Figure 5:
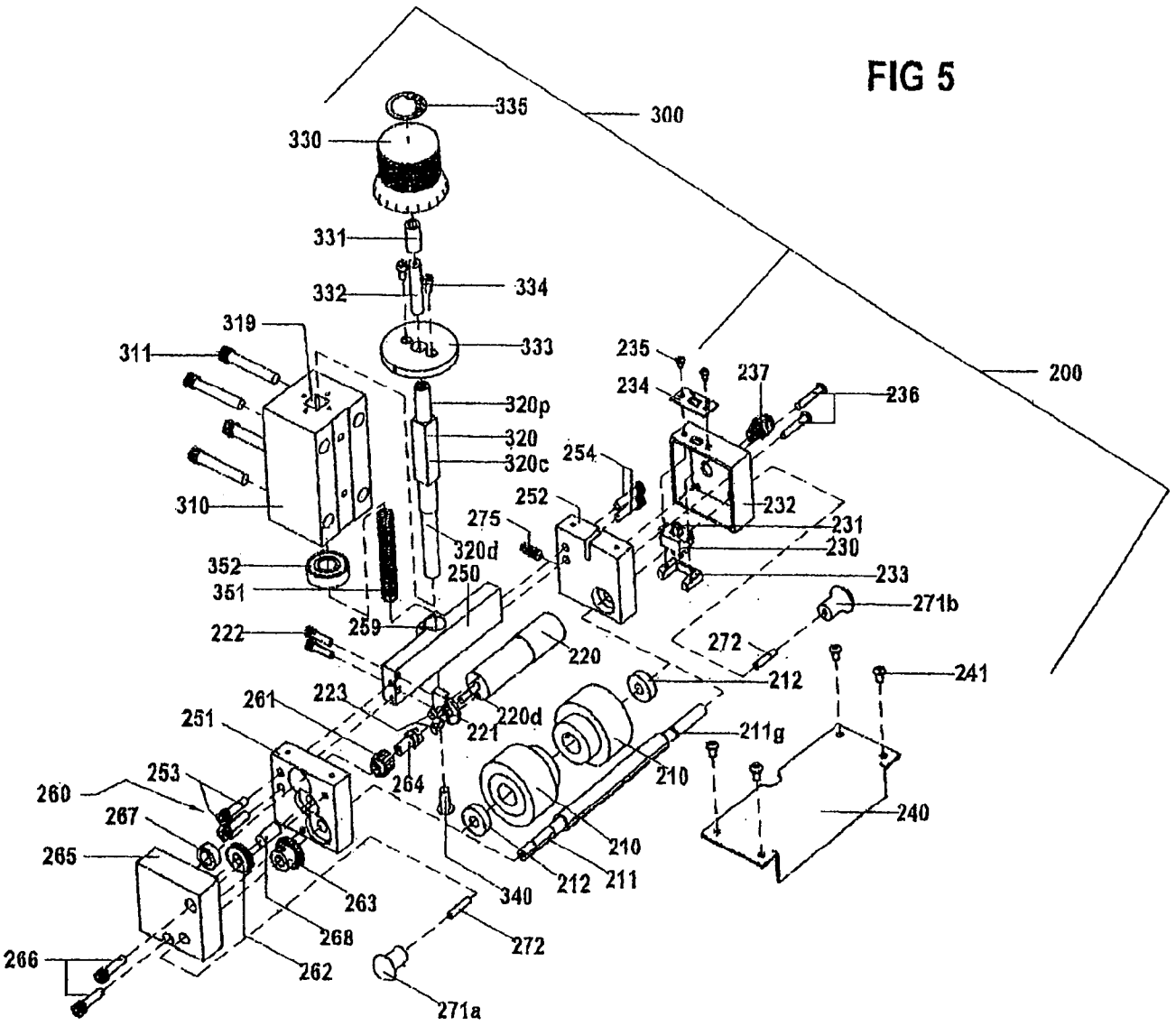
FIG. 5 is an exploded view of the gating assembly and height adjustment assembly shown in FIG. 3.

Referring generally to FIGS. 3–5, one embodiment of a suitable gating assembly 200 includes a pair of friction retard rollers 210 driven by an auxiliary electric motor 220 with the rotational direction of the auxiliary electric motor 220 controlled by a switch 230, such as a DPDT slide switch.

The specific embodiment of a suitable gating assembly 200 shown in FIGS. 3–5 includes an auxiliary electric motor 220 secured to a mounting base 250 by a motor mount 221. The motor mount 221 is attached to the mounting base 250 by machine screws 222 and attached to the auxiliary motor 220 by machine screws 223.

The retard rollers 210 are mounted upon a central shaft 211. The central shaft 211 is rotatably supported upon bearings 212 between a first support arm 251 and a second support arm 252. The first and second support arms 251 and 252 are secured to opposite ends (unnumbered) of the mounting base 250 by machine screws 253 and 254 respectively. The drive shaft 220*d* of the auxiliary electric motor 220 is operably connected to the central shaft 211 upon which the retard rollers 210 are mounted by means of a gear assembly 260. The gear assembly 260 includes a first spur gear 261 driven by the auxiliary electric motor 220, a second spur gear 262 driven by the first spur gear 261, and a third spur gear 263 driven by the second spur gear 262. The first spur gear 261 is fixedly attached to the drive shaft 220*d* of the auxiliary electric motor 220 by a shaft lock 264, which is rotatably retained in position proximate the first support arm 251 by bearing 267. The second spur gear 262 is rotatably mounted upon a pin 268 attached to the first support arm 251. The third spur gear 263 is fixedly attached to the central shaft 211 by a set screw (not shown). The gears and other attendant components of the gear assembly 260 are positioned within recesses (unnumbered) provided in the first support arm 251. A cover 265 is attached over the outside face (unnumbered) of the first support arm 251 by machine screws 266 to retain the gears and other attendant components of the gear assembly 260 in position.

The switch 230 is mounted within a switch housing 232 by means of a switch mount 233 and machine screws 235. The switch housing 232 is secured to the second support arm 252 by machine screws 236. The switch 230 is electrically connected to the auxiliary electric motor 220 by an electrical lead (not shown). A switch position indicator label 234 may be attached by machine screws 235 to the switch housing 232 alongside the slide button 231 of the switch 230 for indicating the rotational direction of the auxiliary electric motor 220 based upon the position of the slide button 231.

Auxiliary electric motor 220 is electrically connected to a power source (not shown). Operation of the auxiliary electric motor 220 is preferably controlled by the main control system (not shown) for the friction sheet feeding machine 10 so that the retard rollers 210 are rotated by the auxiliary electric motor 220 only when the feed rollers 120 are rotated by the primary drive motor. This prevents the retard rollers 210 from continuing to rotate and potentially feeding and/or damaging sheets S stacked within the tray assembly 40 when sheets S are no longer being fed from the sheet stack 500 by feed rollers 120.

Pull knobs 271 extend laterally from each side (unnumbered) of the gating assembly 200, with a first pull knob 271*a* proximate the gear assembly 260 and laterally offset from the cover 265, and a second pull knob 271*b* proximate the switch 230 and laterally offset from the switch housing 232. The pull knobs 271 are connected to the ends (unnumbered) of the central shaft 211 by set screws 272. A cavity (not shown) is provided on the interior face (not shown) of the cover 265 in lateral alignment with the third spur gear 263. The cavity is configured and arranged to accommodate the third spur gear 263 so as to permit the third spur gear 263 to be laterally displaced from engagement with the second spur gear 262 by pulling upon the first knob 271*a* and/or pushing upon the second knob 271*b*. Displacement of the third spur gear 263 from operable engagement with the second spur gear 262 allows an operator to disengage the retard rollers 210 from rotation by the auxiliary electric motor 220 and thereby allow in-use servicing of the friction sheet feeding machine 10 without requiring a complete shut down of the machine 10. A ball plunger 275 is positioned within a longitudinal bore (not shown) in the second support arm 252. The longitudinal bore extends into contact with the laterally extending orifice (unnumbered) in the second support arm 252 through which the central shaft 211 is rotatably retained. An outside radial groove 211*g* is provided on the central shaft 211 for cooperatively and releasably engaging the ball plunger 275 when the central shaft 211, and thereby the retard rollers 210, are returned to the original desired laterally position within the gating assembly 200.

A protective cover 240 can be attached to the top (unnumbered) of the first and second support arms 251 and 252 by machine screws 241 for covering the rotating components of the gating assembly 200, including the drive shaft 220*d* of the auxiliary electric motor 220, the gear assembly 260, the central shaft 211 and the retard rollers 210.

The gating assembly 200 can be secured to the frame 20 by any suitable means for securely positioning the retard rollers 210 in proper lateral alignment with the feed rollers 120 with the desired transverse spacing or gap (unnumbered) between the retard rollers 210 and the feed rollers 120. To accommodate the feeding of sheets S of different thickness, the gating assembly 200 is preferably secured to the frame 20 by a height adjustment system 300, such as exemplified in FIGS. 3–5.

Referring generally to FIGS. 3–5, one embodiment of a suitable height adjustment system 300 includes (i) a mounting block 310 for fixed attachment of the height adjustment system 300 to the frame 20, and (ii) a lift shaft 320 slidably engaged by the mounting block 310 with a distal end 320*d* of the lift shaft 320 engaging the mounting base 250 of the gating assembly 200 and a proximal end 320*p* attached to a dial 330. The height adjustment system 300 is operable for transversely adjusting the position of the lift shaft 320 relative to the mounting block 310 by rotation of the dial 330 and thereby adjusting the transverse position of the retard rollers 210 in the gating assembly 200 relative to the feed rollers 120.

The specific embodiment of a suitable height adjustment system 300 for the gating assembly 200 shown in FIGS. 1–5 includes a mounting block 310 capable of fixed attachment to the cross member 25 of the frame 20 by machine screws 311. A transverse channel 319 of squared cross-section extends transversely through the mounting block 310.

The lift shaft 320 is slidably engaged within the transverse channel 319. The distal end 320*d* of the lift shaft 320 passes through a transversely extending bore 259 in the mounting base 250 of the gating assembly 200, with the mounting base 250 prevented from sliding off the lift shaft 320 by a cap screw 340 attached to the distal end 320*d* of the lift shaft 320. The mounting base 250 is biased against the cap screw 340 by a spring 351 positioned around the distal end 320*d* of the lift shaft 320. The proximal end 320*p* of the lift shaft 320 is threadably engaged to a dial 330 by means of an insert 331 and a threaded shaft 332, whereby rotation of the dial 330 is translated to transverse movement of the lift shaft 320 within the transverse channel 319 in the mounting block 310. A central portion 320*c* of the lift shaft 320 has a squared cross-section which mates with the transverse channel 319 in the mounting block 310 to prevent the lift shaft 320 from rotating when the dial 330 is rotated.

A mounting flange 333 can be secured atop the mounting block 310 between the dial 330 and the mounting block 310 by recessed machine screws 334. The mounting flange 333 is designed to provide sufficient frictional contact with the dial 330 to prevent undesired vibrational rotation of the dial 330. A dial position indicator 335 for indicating the height of the retard rollers 210 (e.g., the size of the gap between the friction belt 130 and the retard rollers 210) may be positioned atop the dial 330. The dial 330 can be marked with a series of peripherally spaced marks (unnumbered) and the mounting flange 333 marked with a single peripheral mark (unnumbered) for purposes of indicating the currently selected position of the dial 330 as the marking on the dial 330 aligned with the marking on the mounting flange 333.

A bearing 352 is preferably positioned around the distal end 320*d* of the lift shaft 320 between the mounting block 310 and the mounting base 250, with the bearing 352 preferably recessed into the mounting block 310 and the biasing spring 351 pressed between the mounting block 310 and the bearing 352.

Use

A stack 500 of sheets S is positioned upon the tray assembly 40 with the leading edges $S_{lead}$ of the sheets S contacting the cross member 25. A sheet alignment guide system (not shown) is typically employed to ensure that the stack 500 remains properly positioned and uniformly stacked throughout the feeding operation. Height adjustment dial 330 is rotated until the desired gap between the friction belt 130 and the retard rollers 210 is achieved, based primarily upon the physical characteristics of the sheets S in the stack 500 (e.g., thickness and stiffness). Switch 230 is toggled to the desired direction of rotation (concurrent or counter current), again based primarily upon the physical characteristics of the sheets S in the stack 500 (e.g., tackiness). Activation of the friction sheet feeding machine 10 permits friction feed rollers 120 and friction retard rollers 210 to simultaneously rotate to effect feeding of the lowermost sheet $S_{low}$ from stack 500 by the friction belt 130 while the retard rollers 210 contact the overlying sheet $S_{over}$ for purposes of preventing the overlying sheet $S_{over}$ from feeding with the lowermost sheet $S_{low}$ while positioning the overlying sheet $S_{over}$ for subsequent feeding by the friction belt 130.

The retard rollers 210 may be effectively rotated over a wide range of peripheral speeds. Generally, a peripheral speed of between about 2 cm/min to about 5 cm/min is preferred when the retard rollers 210 are rotated in a concurrent direction, and a peripheral speed of between about 2 cm/min to about 10 cm/min is preferred when the retard rollers 210 are rotated in a counter current direction. A peripheral speed of greater than about 5 cm/min in the concurrent direction tends to result in improper separation of product or multiple feeds, while a peripheral speed of less than about 2 cm/min. in the concurrent direction tends to result in uneven wear or flat spots on the retard rollers 210. A peripheral speed of greater than about 10 cm/min in the counter current direction tends to damage the leading edge $S_{lead}$ of sheets S while a peripheral speed of less than about 2 cm/sec in the counter current direction tends to result in uneven wear or flat spots on the retard rollers 210.

What is claimed is:

1. A friction sheet feeding machine, comprising:

(a) a tray effective for holding a stack of sheets with a lowermost sheet, (b) a driven friction feed roller configured and arranged for pulling the lowermost sheet in a machine direction from underneath the stack, (c) a driven friction retard roller above the friction feed roller for contacting a leading edge and any exposed upward facing major surface of a sheet immediately overlying the lowermost sheet so as to retard advancement of the overlying sheet, wherein driven rotation of the friction retard roller is reversible as between a concurrent direction relative to the friction feed roller when in a first state and a countercurrent direction relative to the friction feed roller when in a second state, (d) a first motor operably connected to the friction feed roller for driving the friction feed roller, and (e) a second motor operably connected to the friction retard roller for driving friction retard roller, (f) wherein the first and second motors are operably associated wherein the second motor is operational only when the first motor is operated.

2. The machine of claim 1 wherein the machine further comprises a switch for electrically switching the driven rotational direction of the friction retard roller as between the first state and the second state.

3. The machine of claim 1 further comprising a support fame wherein the tray, the driven friction feed roller and the driven friction retard roller are each attached to the frame with the driven friction retard roller releasably connected to the frame.

* * * * *

UNITED STATES PATENT AND TRADEMARK OFFICE

CERTIFICATE OF CORRECTION

PATENT NO. : 6,932,338 B1
DATED : August 23, 2005
INVENTOR(S) : William L. Popejoy It is certified that error appears in the above-identified patent and that said Letters Patent is hereby corrected as shown below:

Title page,
Item [57], ABSTRACT,
Line 9, replace “overly” with -- overlying --.

Column 8,
Line 45, insert -- the -- between “driving” and “friction roller,”.
Line 47, replace “wherein” with -- whereby --.

Signed and Sealed this

Twenty-first Day of February, 2006

JON W. DUDAS
*Director of the United States Patent and Trademark Office*